US005561437A

United States Patent [19]

Phillips et al.

[11] Patent Number: 5,561,437

[45] Date of Patent: Oct. 1, 1996

[54] TWO POSITION FOLD-OVER DIPOLE ANTENNA

[75] Inventors: James P. Phillips, Lake in the Hills; Eric L. Krenz, Crystal Lake, both of Ill.

[73] Assignee: Motorola, Inc., Schaumburg, Ill.

[21] Appl. No.: 323,653

[22] Filed: Oct. 17, 1994

Related U.S. Application Data

[63] Continuation-in-part of Ser. No. 306,867, Sep. 15, 1994, abandoned.

[51] Int. Cl.[6] ..... H01Q 1/24

[52] U.S. Cl. ..... 343/702; 343/805; 343/822; 455/89

[58] Field of Search ..... 343/702, 806, 343/795, 805, 880–882, 822; 455/89, 90; H01Q 1/24

[56] References Cited

U.S. PATENT DOCUMENTS 4,313,119 1/1982 Garay et al. ..... 343/806

4,992,799 2/1991 Garay ..... 343/702

5,337,061 8/1994 Pye et al. ..... 343/702

FOREIGN PATENT DOCUMENTS

415703A1 3/1991 European Pat. Off. .

*Primary Examiner*—Michael C. Wimer

*Attorney, Agent, or Firm*—Randall S. Vaas

[57] ABSTRACT

A radio communication device includes a radio signal source (415) positioned in the first housing portion (101). A second housing portion (103) has a first end movably supported on the first housing portion such that the housing portions are reconfigurable between an extended position and a collapsed position. A dipole antenna (107) has a first arm (440) positioned in the first housing portion and a second arm (441) positioned in the second housing portion. A respective end of each of the arms is connected to the signal source. Plates (450, 451) are positioned on the first and second housing portions and connected to the antenna arms such that they are capacitively coupled when the housing portions are collapsed and are not coupled when the housing portions are extended.

18 Claims, 7 Drawing Sheets

TWO POSITION FOLD-OVER DIPOLE ANTENNA

This is a continuation-in-part of U.S. patent application Ser. No. 08/306,867, filed Sep. 15, 1994, abandoned.

FIELD OF THE INVENTION

The present invention pertains to antennas for radio communication devices.

BACKGROUND OF THE INVENTION

Radio communication devices include a transmitter and/or a receiver coupled to an antenna which emits and/or detects radio frequency signals. The device may include a microphone for inputting audio signals to a transmitter or a speaker for outputting signals received by a receiver. Examples of such radio communication devices include one-way radios, two-way radios, radio telephones, personal communication devices, and a variety of other equipment. These communication devices often have a standby configuration wherein the device is collapsed for storage and an active communication configuration, wherein the antenna is extended for optimum performance.

For radio telephones and two-way radios, it is typically desirable that these devices have a small size during a standby mode to facilitate storage and transport thereof. For example, users prefer that the radio telephones are small enough in the standby mode to permit storage in a shirt or jacket pocket. In the active communication state, it is desirable for the device to be sufficiently long to position the speaker adjacent to the user's ear, the microphone near the user's mouth, and the antenna away from the user's body. It is desirable for the antenna to be positioned away from the user's body since the user's body is a large conductor that interferes with radio frequency signal reception. One particularly effective way of positioning the antenna away from the user's body is to extend the antenna away from the device body during use. By providing an antenna which collapses for storage and extends for optimum performance during an active communication mode, the antenna's high performance active mode operation is provided in a readily storable device.

A difficulty encountered with such reconfigurable communication devices is providing a high performance antenna in the standby mode. The body of the device, including internal electronic circuitry within the body, is typically in the reactive near-field of the antenna in the storage position. This object in the reactive near-field of the antenna can degrade standby performance of devices, such as radio telephones, which receive paging signals, electronic mail, or call alerting signals in the standby mode.

Accordingly, it is desirable to provide an antenna having high performance characteristics when the communication device is extended in an active communication mode and when the communication device is collapsed in a standby mode of operation.

DETAILED DESCRIPTION OF THE DRAWINGS

A radio communication device includes a radio signal source positioned in a first housing portion. A second housing portion has a first end movably supported on the first housing portion such that the first and second housing portions are reconfigurable into an extended position and a collapsed position. A dipole antenna has a first arm positioned in the first housing portion and a second arm positioned in the second housing portion. An end of each of the first and second arms is connected to the radio signal source. First and second conductors are positioned on the first and second housing portions and electrically connected to respective ends of the first and second arms. The first and second conductors are capacitively coupled when the first and second housing portions are collapsed and are not capacitively coupled when the first and second housing portions are extended. Accordingly, the impedance of the antenna remains substantially unchanged in the open and closed positions, such that the antenna is appropriately tuned in both positions. The closed position performance is thus substantially enhanced.

Initially, it is noted that the antenna system according to the invention is illustrated in a radio telephone 100 (FIG. 1) including a flap, wherein the immediate invention is particularly advantageous. However, the invention may also be advantageously employed in other radio communication devices having antennas and multiple housing portions that move relative to one another. Accordingly, "device" as used herein refers to all such radio communication equipment.

Figure 1:
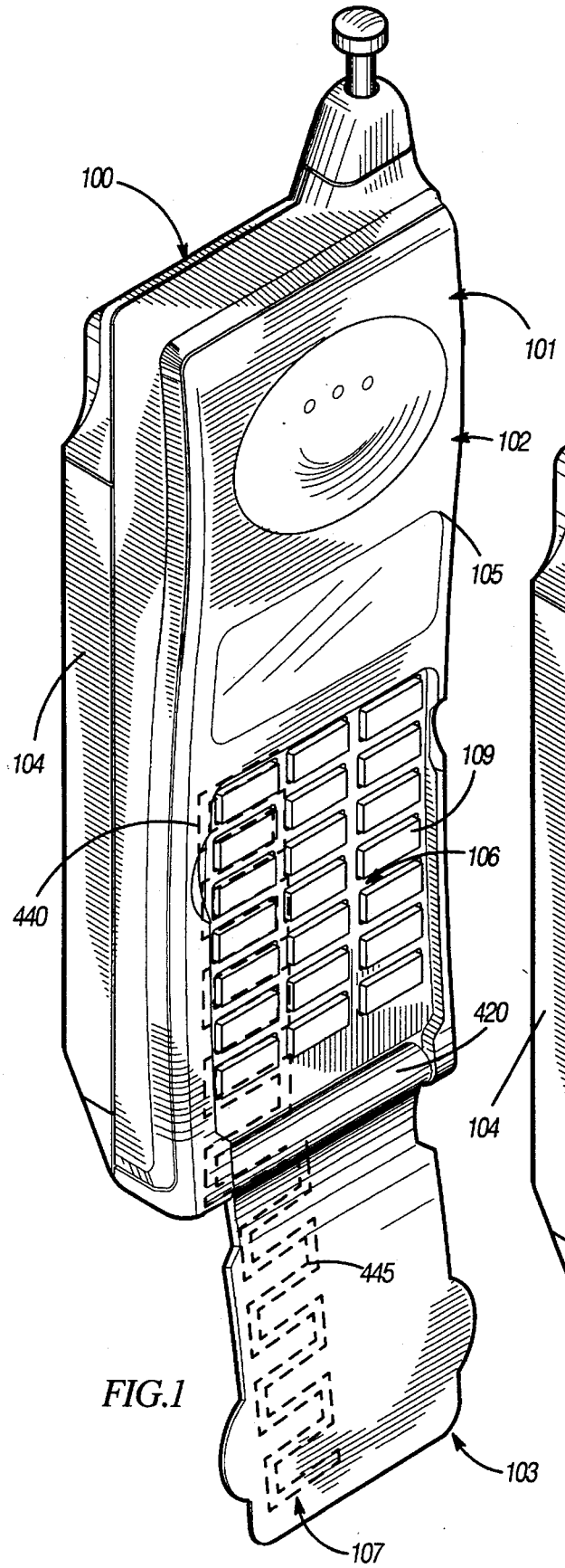
FIG. 1 is a front elevational view of a radio telephone in an extended, active communication position.

A radio telephone 100 incorporating the invention is illustrated in FIG. 1. The radio telephone includes a housing 102 having a first housing portion 101 and a second housing portion 103. In the illustrated embodiment, the first housing portion 101 is a radio telephone body and the second housing portion 103 is a flap pivotally connected to the body. The second housing portion 103 moves between an extended position illustrated in FIG. 1, during an active communication mode and a collapsed, or closed position, illustrated in FIG. 2, in a standby mode.

Figure 3:
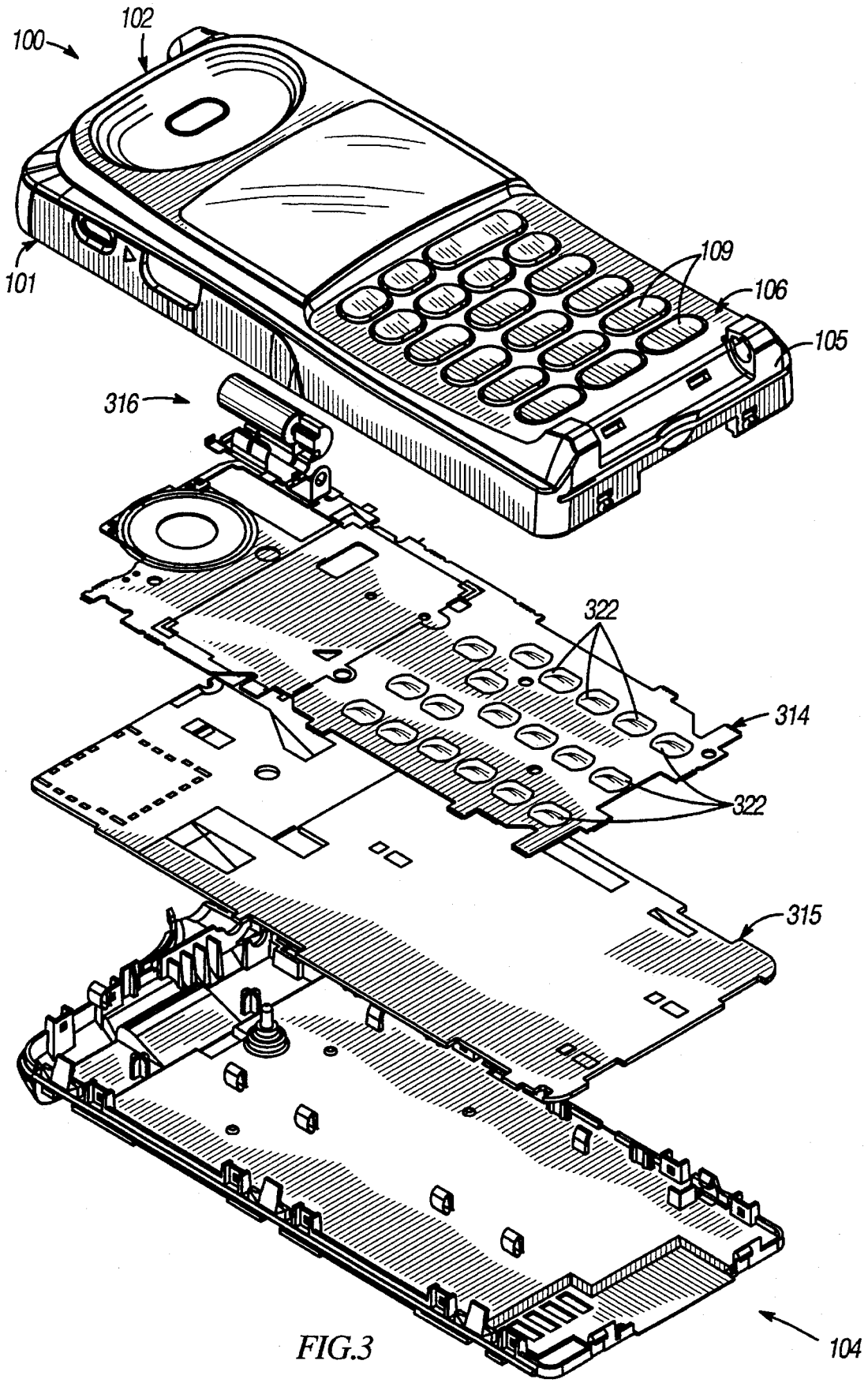
FIG. 3 is a top exploded perspective view illustrating a front housing, a radio frequency (RF) printed circuit board, a logic circuit board, and a rear housing of the radio telephone according to FIG. 1.

The first housing portion 101 includes a back body housing section 104 and front body housing section 105 which are interconnected to define an interior volume. The first housing portion 101 houses electronic circuit including an RF circuit board 315 (FIG. 3) and logic circuit board 314. A transceiver circuit 415 (FIG. 4), which is a radio signal source, is supported on logic circuit board 314. The transceiver circuit transmits and receives radio frequency signals, and may be implemented using any suitable commercially available transceiver circuit. A keypad 106 (FIG. 1) is positioned on first housing portion 101 such that the keys 109 (only some of which are numbered) associated with the keypad are accessible for manual actuation by the user to selectively close respective popple switches 322 (FIG. 3).

Figure 2:
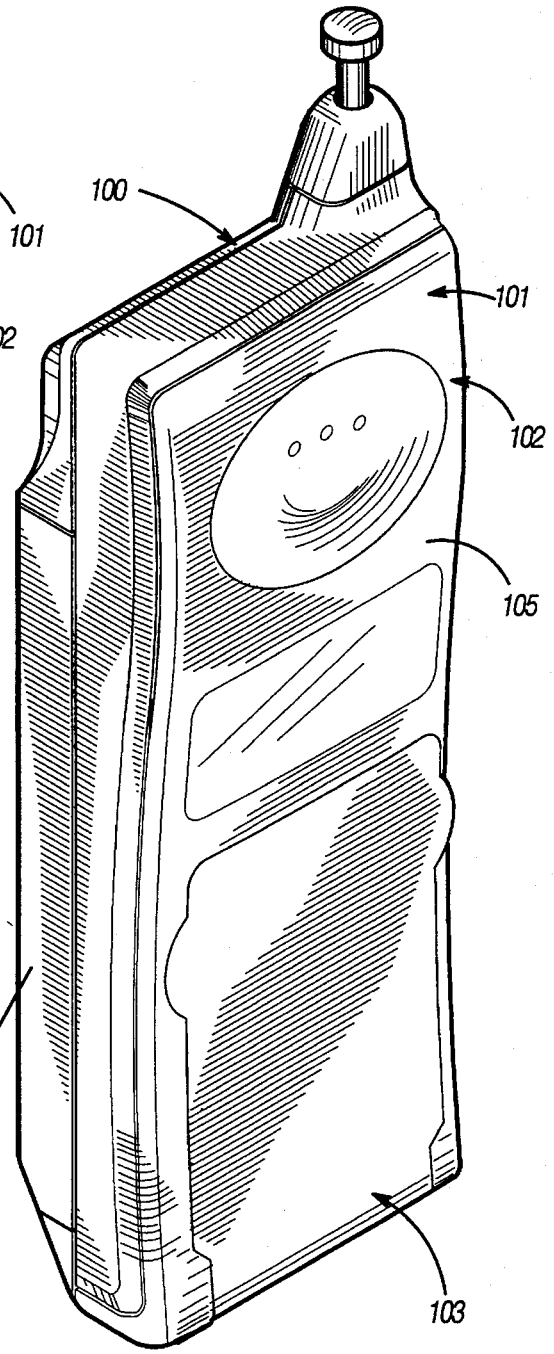
FIG. 2 is a front perspective view of the radio telephone according to FIG. 1 in a closed, collapsed, position.

The second housing portion 103 (FIG. 1) at least partially covers keypad 106 when closed. The cover may be longer to cover all the keys 109. The second housing portion prevents inadvertent actuation of the keys 109 it covers when the second housing portion is closed as illustrated in FIG. 2. Additionally, the second housing portion may be used to place the radio telephone in a standby mode when closed.

The radio telephone 100 includes dipole antenna 107 having antenna arm 440 (FIG. 4) in the first housing portion and an antenna arm 441 in the second housing portion. The antenna arm 440 is manufactured of a suitable electrically conductive materiel such as copper, a copper alloy, aluminum alloy or the like. The conductor is thin and has a serpentine configuration such that when it is supported on the surface 460 (FIG. 5) of the first housing portion 101, it extends around keys 109 of keypad 106. In the material embodiment, antenna arm 440 is $\lambda/4$ in electrical length. Alternate embodiments may use other resonant length dipoles such that arm 440 is an odd integer multiple of $\lambda/4$. End 442 of antenna arm 440 is connected to a transmission line 417 by a conductor 443.

A plate 450 (FIG. 5) is attached to surface 460 of front body housing section 105. The plate is constructed of any suitable electrical conductor, such as copper, a copper alloy, aluminum, or an aluminum alloy. Plate 450 is electrically connected to feed point 442 by conductor 461.

A bezel 447 having openings 464 aligned with keys 109 covers antenna arm 440 and plate 450. Bezel 447 is attached to the front body housing section 105 and front flap housing section 112 is attached to rear flap housing section 111 using a suitable adhesive or fastener.

The second housing portion 103 includes a front flap housing section 112 and rear flap housing section 111. The front flap housing section is inserted over plate 451 and antenna arm 441 in recess 463.

Figure 4:
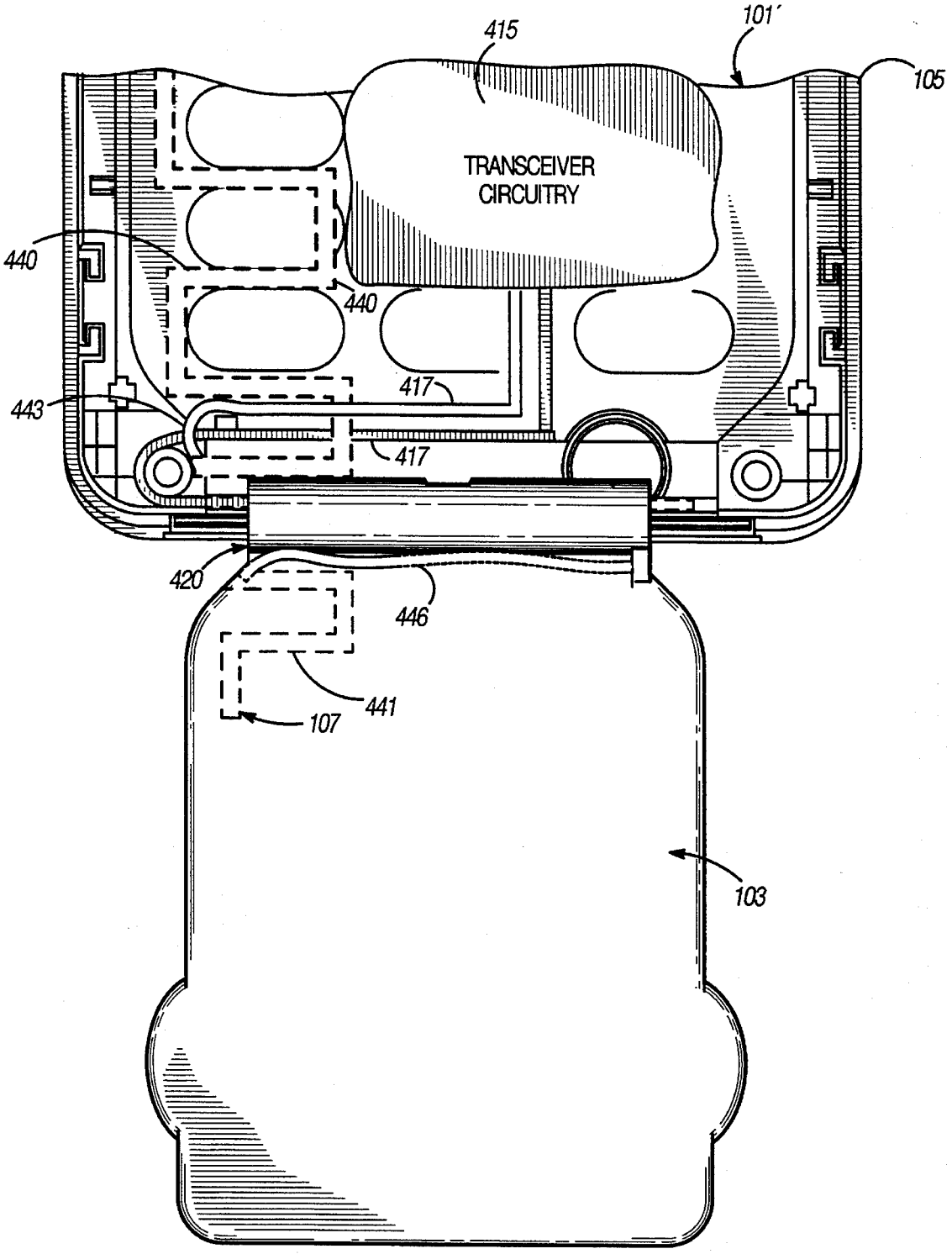
FIG. 4 is a fragmentary top elevational view illustrating a front housing interior and flap and schematically showing transceiver circuit.
Figure 5:
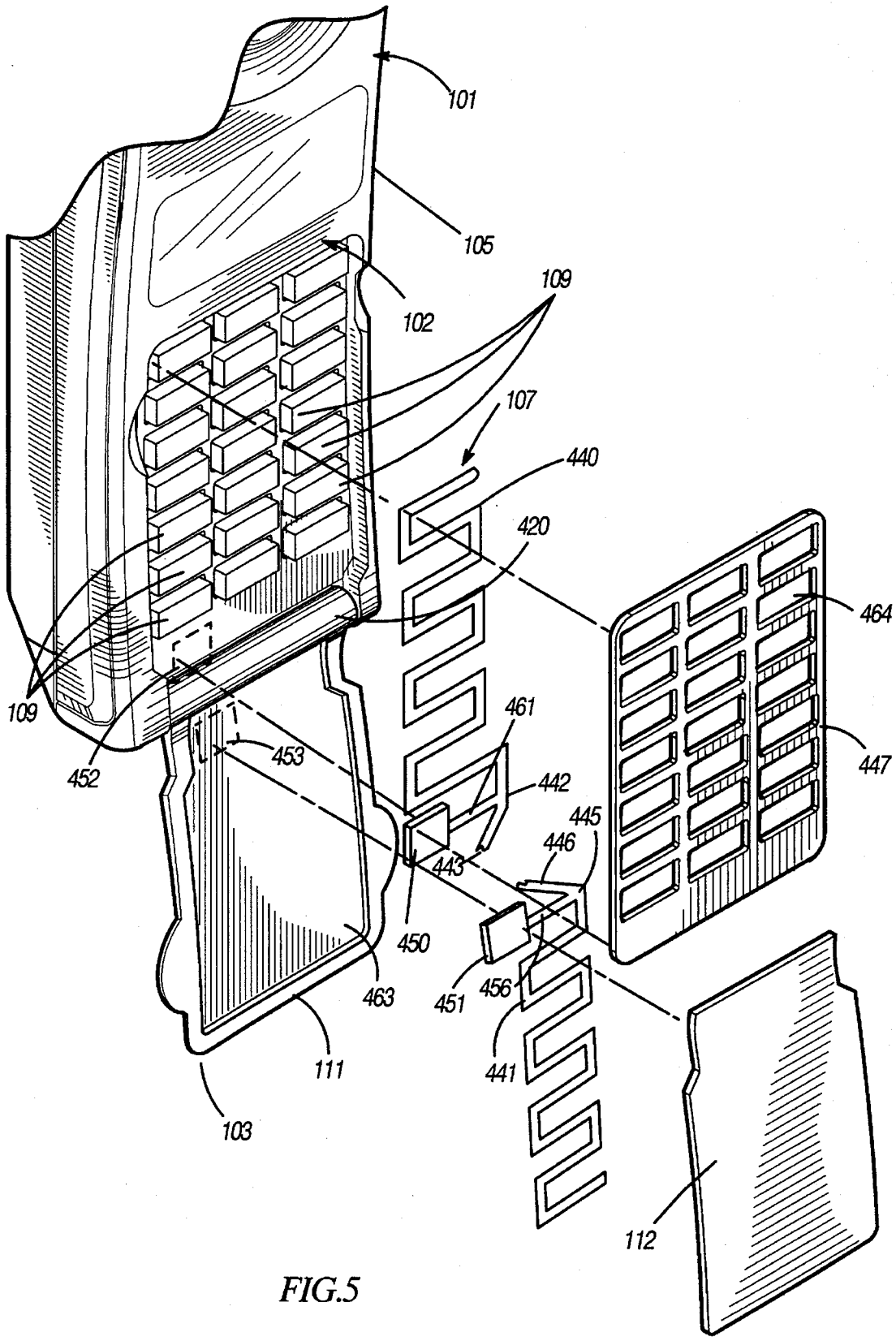
FIG. 5 is an exploded perspective view of the radio telephone antenna assemblies.

The antenna arm. 441 is of substantially the same construction as antenna arm 440. In the preferred embodiment, antenna arm 441 (FIG. 5) is $\lambda/4$ in electrical length. Alternate embodiments may use other resonant length dipoles such that arm 440 is an odd integer multiple of $\lambda/4$. The antenna arm 441 also has a serpentine configuration. Antenna arm 441 is attached to surface 462 in recess 463 of rear flap housing section 111 using a suitable commercially available adhesive. End 445 of antenna arm 441 is connected to transmission line 417 by a conductor 446. Conductor 443 and conductor 446 are flex strip conductors that connect the dipole antenna 107 to transceiver circuit 415 (FIG. 4). The antenna arm 440 and the antenna arm 441 form dipole antenna 107.

Antenna arm 441 (FIG. 5) is of the same plan configuration as antenna arm 440 such that these conductors are mirror images of one another when the first housing portion 101 and the second housing portion 103 are closed. Thus in the closed position, antenna arm 440 and the antenna arm 441 are substantially parallel with one another, are aligned, such that the antennas overlap when the first housing portion 108 and the second housing portion are in the collapsed position.

A plate 451 (FIG. 5) is connected to the feed point 445 of antenna arm 441 by a conductor 456. The plate is attached to a surface 462 of rear flap housing section 111. Plate 451 is constructed of a suitable electrically conductive material, such as a copper alloy. The plate is of a generally rectangular configuration, and is of substantially the same dimension as plate 450.

The bezel 447 and the front flap housing section 112 are manufactured of a suitable polymeric material identical to the materiel, such as polycarbonate, which is used for the front body housing section 105, the back body housing section 104, the front flap housing section 112 and the rear flap housing section 111. The polymeric material utilized has a suitable, low dielectric constant, and is of a conventional construction.

The RF circuit board 315 (FIG. 3) and the logic circuit board 314 are printed circuit boards. Transceiver circuit 415 (FIG. 4) for the radio telephone 100 is mounted on RF circuit board 315. These circuit boards are assembled into the first housing portion 101 and held in position when the front body housing section 105 and back body housing section 104 are assembled by any suitable conventional means, such as using snap connectors. A vibrator assembly 316 is supported on logic circuit board 314 such that it is positioned against the front housing when the logic circuit board 314 abuts with the front body housing section 105.

Figure 6:
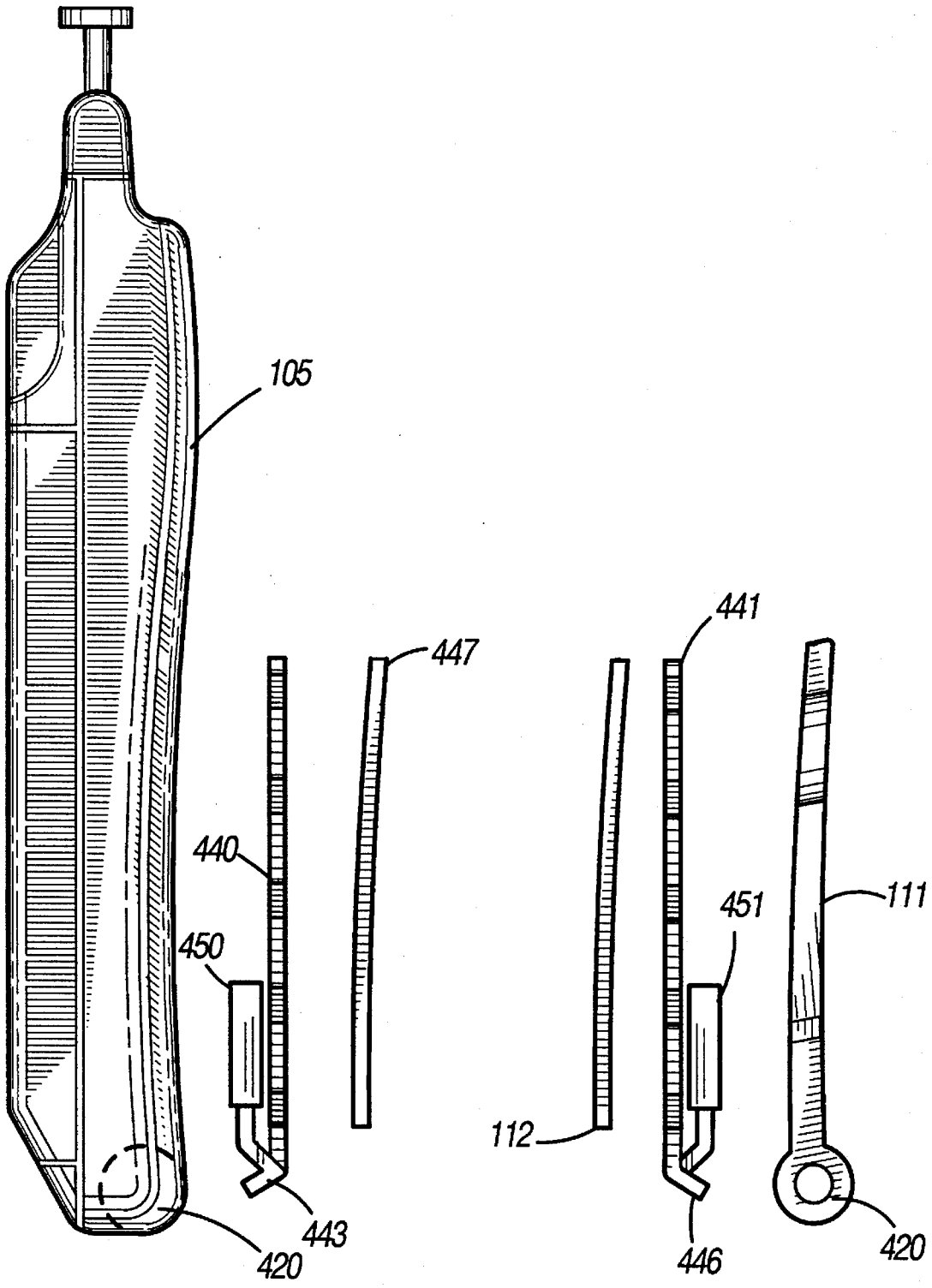
FIG. 6 is an exploded side elevational view of the antenna housing according to FIG. 7 with the antenna system oriented in the closed position.

To assemble the antenna assembly to the radio telephone 100, plate 450 (FIGS. 5 and 6) is attached to surface 460 of front body housing section 105 at location 452. The antenna arm 440 is then assembled to surface 460 of front body housing section and connected to plate 450 by conductor 461, which may be provided by any suitable electrical conductor. The bezel 447 is attached to front body housing section 105 using a suitable adhesive, a fastener, or the like, with antenna arm 440 and plate 450 sandwiched there between.

Plate 451 is attached to surface 462 of rear flap housing section 111 at location 453 using a suitable adhesive or a fastener. The plate 451 is connected to feed point 445 of antenna arm 441 by conductor 456. The front flap housing section 112 is then attached to the rear flap housing section 111 using a suitable adhesive, with the antenna arm 441 and plate 451 securely sandwiched there between.

Arm 440 and arm 441 are electrically connected to the transceiver circuit 415 by conductors 443 and 446 and transmission line 417.

Plate 450 and plate 451 are generally rectangular, planar members in configuration. When assembled, the plates are positioned such that they are vertically aligned to create a capacitive coupling when the flap is in the closed position, illustrated in FIG. 2. However, the plates may have any suitable configuration to facilitate positioning on front body housing section 105 and front flap housing section 112.

Figure 7:
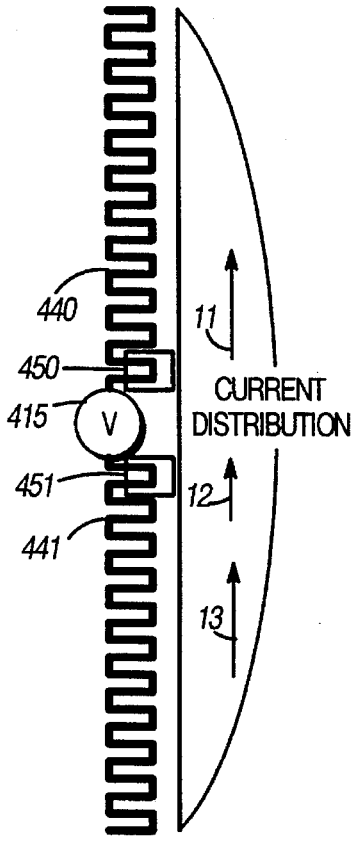
FIG. 7 illustrates the orientation of the arms and the current produced thereby with the arms in their fully extended maximum length position.
Figure 11:
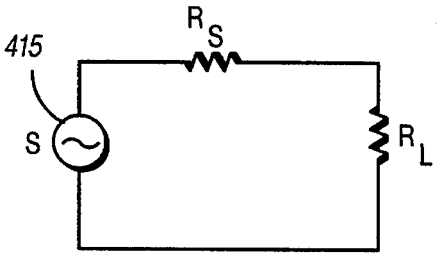
FIG. 11 is a circuit schematic illustrating the impedance of a radio telephone antenna system with the radio telephone in the extended open position.

In operation, the antenna arm 440 and the antenna arm 441 are extended to the position illustrated in FIG. 7 when the first housing portion 101 and second housing portion 103 are extended in the open position illustrated in FIG. 1. Most preferably, the antenna arm 440 and the antenna arm 441 are oriented in the same plane for optimum performance. In this position, the impedance RL (FIG. 11) of the dipole antenna in the configuration of FIG. 7 is selected to be in the range of 50 to 75 ohms, which is equal to the source impedance RS, and the impedance of transmission line 417. The currents I1 (FIG. 7), I2 and I3 are collinear and of substantially the same direction, and the reactive near field of each antenna arm is predominantly in air. The dipole antenna also performs well when the arm are not fully extended, but are positioned relative to one another at an angle of approximately 120–180 degrees.

Figure 8:
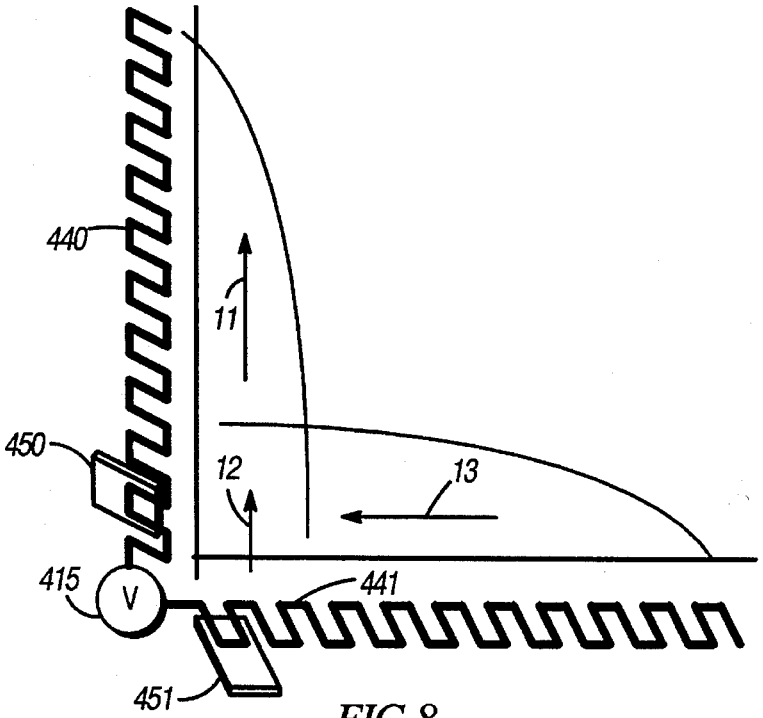
FIG. 8 illustrates the antenna currents and fields when the housing sections are in the position oriented at ninety degrees.

Alternatively, if the antenna system is used in a device having a position where the arms are angled approximately 90° relative to one another, such as in personal communicator, the arms will be oriented as illustrated in FIG. 8. In this position, plate 450 and plate 451 are not coupled. Although antenna performance is degraded in this position, the antenna impedance is not significantly altered, and performance is good without adding a capacitance. In this position, current I1, I2 and I3 are not collinear. They are however oriented such that their effects will not cancel one another.

Figure 9:
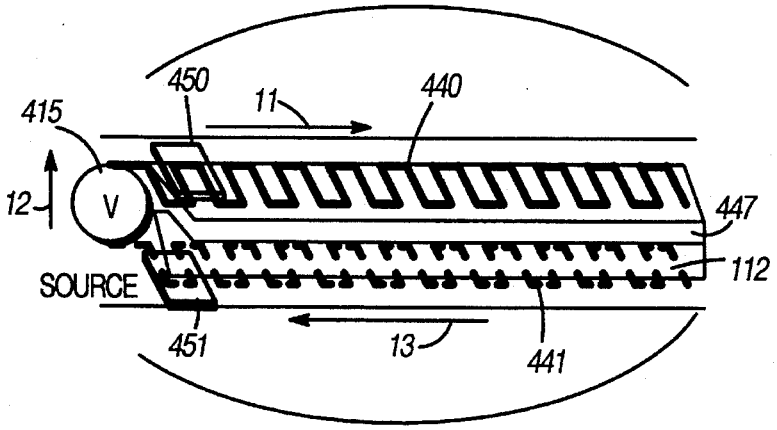
FIG. 9 illustrates the antenna assemblies in the fully collapsed position.

To reduce the physical size of the radio communication device incorporating dipole antenna 107, such as to reorient the device to a storage position, second housing portion 103 is rotated to the closed, storage position of FIG. 2. When the first housing portion 101 and second housing portion 103 are in the fully closed position illustrated in FIG. 2, the antenna arm 440 and antenna arm 441 are oriented as illustrated in FIG. 9. The antenna arms are spaced by the thickness of dielectric material of bezel 447 plus the thickness of the dielectric material of front flap housing section 112.

Figure 12:
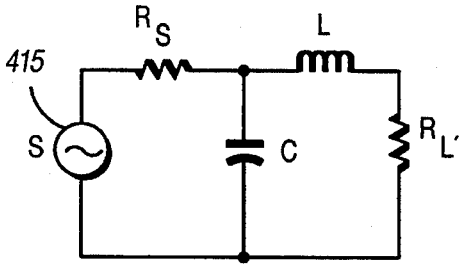
FIG. 12 is a circuit schematic illustrating the impedance of the radio telephone impedance with the radio telephone in the collapsed storage position.

In the fully closed position, illustrated in FIG. 9, the effectiveness of the antenna is reduced. Currents I1 and I3 are orthogonal to current I2, and currents I1 and I3 effectively cancel one another. Current I2 is the remaining current which emits energy. This small effective length of the current producing portion of the antenna causes radiation resistance RL' (FIG. 12) of the dipole antenna 107 to fall to a very low value of 3–10 ohms. This represents a serious resistance mismatch with the transmission line 417, which is tuned to match the impedance of the arms in the fully extended position, which is 50–75 ohms. In addition to the large difference in the resistance component, there is a large reactance L (FIG. 12) introduced by the transmission line, the arms of the dipole antenna and the dielectric material located there between. The dielectric material is provided by members between the antennas, which are bezel 447 and front flap housing section 112. The effect of the resistance inequality and added reactance reduces the antenna performance in the stored position.

The capacitance C (FIG. 12) provided by the capacitive coupling of plate 450 (FIG. 5) and plate 451, which are located near hinge 420 and are connected at the source end of the antenna sections, is added in parallel with the antenna impedance only when the dipole antenna 107 is in the stored position illustrated in FIG. 2. The added capacitance in parallel with the antenna resistance RL' and the reactance L, produces a resulting impedance that is matched to the transmission line 417. Selection of a dielectric having desired dielectric constant and thickness, and the close proximity of the plates which is controlled by selecting the thickness of bezel 447 and front flap housing section 112, allows the dipole antenna to have substantially the same impedance characteristic in the open and closed position. This significantly improves antenna performance in the closed position.

Figure 10:
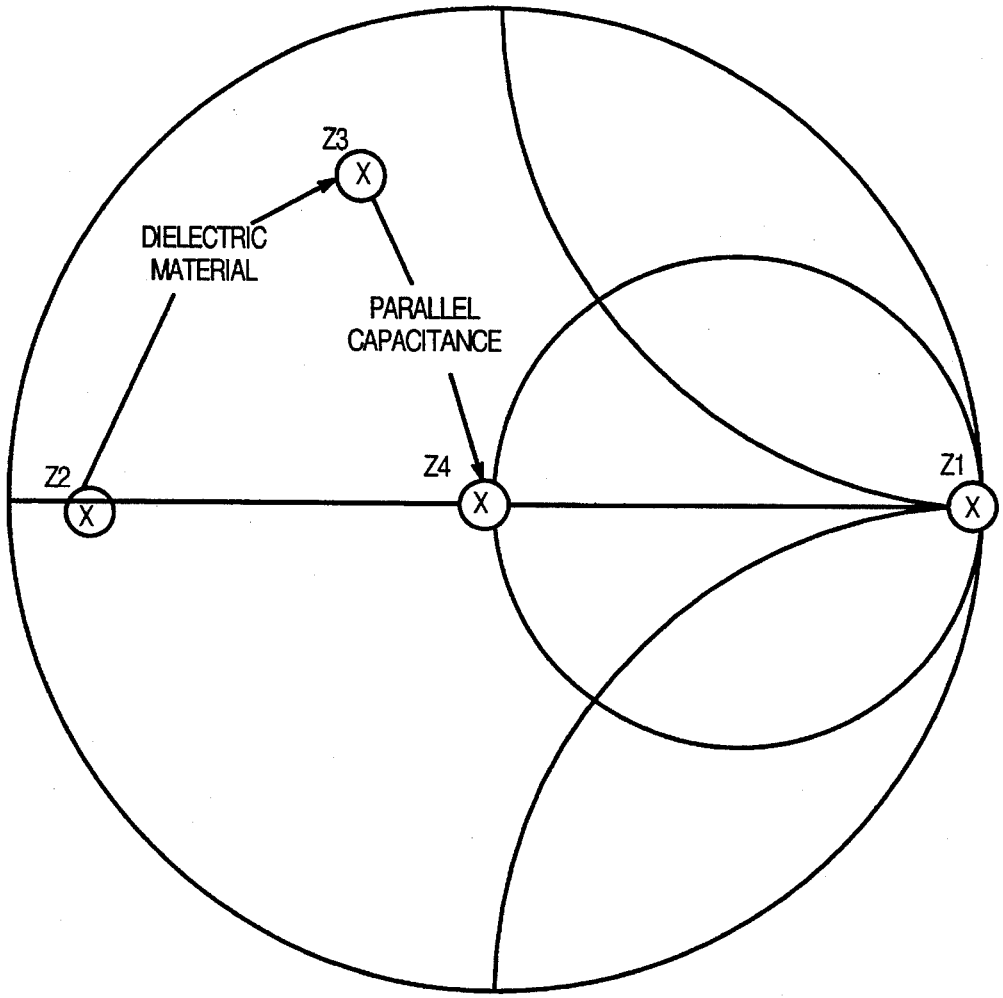
FIG. 10 is a Smith chart illustrating the relative impedance of the antenna in different positions and how impedance matching is accomplished.

The Smith chart of FIG. 10 illustrates mapping of the reactive impedance to a desired impedance, which is 50 Ohms at point Z4. The impedance of Z4 is the impedance of the transmission line, and it is desirable that the impedance of the antenna is matched to the impedance of the transmission line. In the open position of FIG. 2, the impedance RL of the dipole antenna 107 is 50 ohms. In the closed position, without dielectric bezel 447 and flap housing section 142, and without capacitor plate 450 and 451, the impedance of the antenna would change to approximately 3 to 10 ohms. That point is represented by Z2. If the dielectric material of bezel 447 and front flap housing section 112 is not present, the impedance value of the dipole antenna in the closed position would be Z2 and thus, uncompensatable by a parallel component.

Because the dielectric material of bezel 447 and front flap housing section 112 is positioned between the arms 440 and 441, the antenna impedance in the closed position is Z3. By selecting the thickness of the dielectric material of bezel 447 and front flap housing section 112 in view of the dielectric constant of these materials, the impedance value of the dipole antenna moves to Z3. Appropriate selection of Z3 allows Z4 to be reacted by a parallel capacitance connected to the arms of the dipole antenna at the feed point, thus loading the dipole antenna at the feed point. This parallel loading is provided by plate 450 and plate 451, which are capacitively coupled to one another only when the flap is closed, and are connected to the respective feed points of the arms of the dipole antenna.

Thus it can be seen that an antenna is disclosed having improved performance characteristics in the closed position. The improved characteristics are provided by loading the dipole at the feed point by capacitors which are only connected when the flap is closed. In the open position, the plates are not coupled and do not effect the impedance of the antenna arms. The thickness and dielectric constant of the dielectric material between the capacitive plates is selected to affect a particular impedance on the antenna in the closed position.

What is claimed is:

1. A radio communication device comprising:

communication circuitry;

a first housing portion, the communication circuitry positioned in the first housing portion;

a second housing portion, the second housing portion having a first end movably supported on the first housing portion such that the first and second housing portions are reconfigurable into an extended position and a collapsed position;

an antenna having a first arm positioned in the first housing portion and a second arm positioned in the second housing portion, a first end of the first arm and a first end of the second arm connected to the the communication circuitry, the first and second arms together providing a dipole antenna in the extended position and being fed at the first ends;

a first conductor positioned in the first housing portion and connected to the first arm;

a second conductor positioned in the second housing portion and connected to the second arm, the first and second conductors being spaced apart when the first and second housing portions are in the extended position and being capacitively coupled when the first and second housing portions are in the collapsed position to add an impedance to the first and second arm impedances and thereby improve performance of the antenna in the collapsed position.

2. The radio communication device as defined in claim 1, further including a hinge connected to the first and second housing portions whereby the first and second housing portions move between the collapsed position and the extended position.

3. The radio communication device as defined in claim 2 wherein each of the first and second arms has a respective feed point connected to the communication circuitry, and wherein the first and second conductors are connected to a respective feed point of the first and second arms.

4. The radio communication device as defined in claim 3, wherein the first and second conductors are first and second plates, respectively, and the feed points are near the hinge.

5. The radio communication device as defined in claim 4, wherein the first and second arms are oriented on the first and second housing portions such that they are vertically aligned when the first and second housing portions are in the collapsed position.

6. The radio communication device as defend in claim 1, wherein the first housing portion includes a first dielectric member and the second housing portion includes a second dielectric member, wherein the first and second dielectric members are positioned between the first and second plates to select a capacitance that the first and second plates add to the dipole antenna.

7. The radio communication device as defined in claim 1, wherein the conductors are plates that add a capacitance in parallel with the antenna's impedance in the collapsed position.

8. A radio telephone comprising:

a transceiver circuit source;

a first housing portion, the transceiver circuit source positioned in the first housing portion;

a second housing portion, the second housing portion having a first end movably supported on the first housing portion such that the first and second housing portions are reconfigurable into an extended position and a collapsed position;

an antenna having a first arm positioned in the first housing portion and a second arm positioned in the second housing portion, a respective end of each of the first and second arms are connected to the transceiver circuit source, the arms together providing a dipole antenna when the housing portions are in the extended position;

a first conductive plate positioned in the first housing portion and connected to the first arm; and a second conductive plate positioned in the second housing portion and connected to the second arm whereby the first and second conductive plates are capacitively coupled when the first and second housing portions are collapsed to alter the impedance of the first and second arms in the collapsed position to improve performance of the antenna and are spaced apart when the first and second housing portions are extended.

9. The radio telephone as defined in claim 8, further including a hinge connected to the first and second housing portions upon which the first and second housing portions rotate between the collapsed position and the extended position.

10. The radio telephone as defined in claim 9 wherein each of the first and second arms is connected to the transceiver circuit source at a respective feed point located near the hinge.

11. The radio telephone as defined in claim 10, wherein each of the first and second conductive plates is positioned near the hinge and proximate a respective one of the first and second arms.

12. The radio telephone as defined in claim 11, wherein the first and second arms are oriented such that they are vertically aligned when the first and second housing portions are in the collapsed position.

13. The radio telephone as defined in claim 12, wherein the first housing portion includes a plurality of keys.

14. The radio telephone as defend in claim 13, wherein the second housing portion is a flap that covers at least a portion of the keys.

15. The radio telephone as defined in claim 14, wherein the first housing portion includes a first dielectric member and the second housing portion includes a second dielectric member, wherein a thickness of the first and second dielectric members selects a capacitance that the first and second conductive plates add to an antenna impedance in the collapsed position.

16. The radio telephone as defined in claim 15, wherein the first dielectric member is a front flap housing section and the second dielectric member is a face plate assembled around the keys.

17. A method of providing a dipole antenna for a radio communication device having first and second housing portions which move relative to one another to plurality of positions, comprising the steps of:

mounting a first arm of the dipole antenna on said first housing portion;

mounting a second arm of the dipole antenna on said second housing portion;

positioning a first plate on one of the first and second housing portions; and positioning a second plate on the other one of the first and second housing portions such that the first and second plates are capacitively coupled to change an impedance of the dipole antenna when the first and second housing portions are in a collapsed closed position and the first and second plates are decoupled when the first and second housing portions are in an extended open position.

18. The method as defined in claim 17, further including the step of connecting the first and second plates to a respective one of the first and second arms at a respective feed point of each of the first and second arms.

* * * * *